US007472447B2

(12) United States Patent
Lougheed

(10) Patent No.: US 7,472,447 B2
(45) Date of Patent: Jan. 6, 2009

(54) PAINTBRUSH WITH ADJUSTABLE HEAD

(76) Inventor: Frederick M. Lougheed, 11799 Lyon Road, Delta, BC (CA) V4E 2S8

( * ) Notice: Subject to any disclaimer, the term of this patent is extended or adjusted under 35 U.S.C. 154(b) by 590 days.

(21) Appl. No.: 10/492,828

(22) PCT Filed: Oct. 9, 2002

(86) PCT No.: PCT/CA02/01524

§ 371 (c)(1),
(2), (4) Date: Sep. 29, 2004

(87) PCT Pub. No.: WO03/032771

PCT Pub. Date: Apr. 24, 2003

(65) Prior Publication Data

US 2005/0039281 A1 Feb. 24, 2005

(30) Foreign Application Priority Data

Oct. 19, 2001 (CA) ..... 2359806

(51) Int. Cl.
*B25G 1/06* (2006.01)

(52) U.S. Cl. ..... 15/144.1; 15/172; 16/900

(58) Field of Classification Search ..... 15/143.1, 15/144.1, 172, 201, 203, 185; 403/96–97, 403/91; 16/900, 249; 294/53.5; 81/177.8
See application file for complete search history.

(56) References Cited

U.S. PATENT DOCUMENTS

| | | | | |
|---|---|---|---|---|
| 763,100 | A * | 6/1904 | Howell | 15/228 |
| 1,268,734 | A | 6/1918 | Lay | |
| 2,581,141 | A | 1/1952 | Raptis | |
| 3,273,192 | A * | 9/1966 | Mazzella | 15/230.11 |
| 4,030,414 | A * | 6/1977 | McGuire | 101/379 |
| 4,469,223 | A | 9/1984 | Smith | |
| 5,207,755 | A | 5/1993 | Ampian | |
| 5,502,859 | A | 4/1996 | Kim | |
| 5,860,902 | A * | 1/1999 | Jang et al. | 492/13 |
| 6,148,467 | A | 11/2000 | Martinsson | |
| 6,155,620 | A | 12/2000 | Armstrong | |
| 6,301,740 | B1 * | 10/2001 | Quiroz | 15/172 |

FOREIGN PATENT DOCUMENTS

| | | |
|---|---|---|
| CA | 1220448 | 4/1987 |
| CA | 2111262 A1 | 6/1995 |
| CA | 2239884 A1 | 6/1997 |
| DE | 19837988 A1 | 2/2000 |
| EP | 0541138 A1 | 5/1993 |

* cited by examiner

*Primary Examiner*—Laura C Guidotti
(74) *Attorney, Agent, or Firm*—Oyen Wiggs Green & Mutala LLP

(57) ABSTRACT

A paintbrush having an adjustable brush head which allows for various positioning of the head with respect to the handle. The paintbrush comprises a wedge-shaped tilt element (30) positioned between the head (20) and the handle (10). The body and the wedge-shaped tilt element can rotate with respect to one another. The wedge-shaped tilt element and the handle can rotate with respect to one another. The handle, the wedge-shaped tilt element and the body are removably secured against one another by a connecting member, such as a nut and bolt assembly passing through apertures which extend through the handle, the wedge-shaped tilt element and the body. Interlocking protrusions may be provided to assist in the handle, the wedge-shaped tilt element and the body being removably secured against one another.

15 Claims, 7 Drawing Sheets

PAINTBRUSH WITH ADJUSTABLE HEAD

FIELD OF THE INVENTION

This invention relates to paintbrushes, more particularly paintbrushes having adjustable brush heads which can be positioned in various orientations with respect to the handle.

BACKGROUND

The paintbrush is the staple tool for all painters, whether professional or amateur. A typical paintbrush comprises a brush head extending straight out from the end of a straight handle.

The prior art includes variations on the typical paintbrush in which the construction of the paintbrush head and/or handle are altered to assist a painter in reaching difficult places such as corners, nooks and crannies or to simply make the painting chore more easily performed. As a result, various paintbrush designs exist in which the paintbrush head is attached to a handle in a fixed orientation.

Herbowi (Canadian Patent No. 2,111,262), discloses a paintbrush having an adjustable head. The head can be tilted through various angles about an axis which extends generally perpendicularly to the handle. The positioning is limited to a two-dimensional plane. A typical paintbrush head cannot be easily converted into this design. The same comments apply to numerous other adjustable paintbrushes, such as the paintbrushes disclosed in Smith (Canadian Patent No. 1,220,448); Perabo (German Patent No. DE 198 37 988 A1); and, Piombino (EP 0 541 138 A1).

Despite the many designs for adjustable paintbrushes which have been proposed and the long history of paintbrush development, the inventors have determined that there remains a need for a paintbrush which is more widely adjustable than existing paintbrushes and is still cost effective to produce.

SUMMARY OF THE INVENTION

This invention provides a paintbrush comprising a body for holding bristles, a handle, a wedge-shaped tilt element and a connecting member for removably holding the body against the handle, with the wedge-shaped tilt element being positioned between the body and the handle. The body and the wedge-shaped tilt element can rotate with respect to one another. The wedge-shaped tilt element and the handle can also rotate with respect to one another.

Preferred embodiments of the invention include locking elements to hold the body, handle and tilt element in a selected orientation relative to one another. The locking elements may comprise protrusions on various parts of the paintbrush. For example:

a) a first set of protrusions may extend from a surface of the handle and be distributed around a first point of rotation, b) a second set of protrusions may extend from a surface of the body and be distributed around a second point of rotation, c) a third set of protrusions may extend from a bottom surface of the wedge-shaped tilt element and be distributed around a third point of rotation, and d) a fourth set of protrusions may extend from a top surface of the wedge-shaped tilt element and be distributed around a fourth point of rotation.

The first set of protrusions and the third set or protrusions are shaped so that they can interlock with one another. The second set of protrusions and the fourth set or protrusions are shaped so that they can interlock with one another. Alternatively, all four sets of protrusions are shaped so that they can interlock with one another. The protrusions may comprise a plurality of triangular protrusions extending radially from the respective points of rotation.

When the protrusions are not engaged with one another, the handle and the wedge-shaped tilt element rotate with respect to one another along a first axis of rotation which links the first point of rotation with the third point of rotation; furthermore, the wedge-shaped tilt element and the body can rotate with respect to one another along a second axis of rotation which links the second point of rotation with the fourth point of rotation.

The connecting member may comprise a nut and bolt assembly extending through apertures in the body, wedge-shaped tilt element and handle.

An end of the handle, distally located from the head may be hollow and adapted to be removably attachable to an end of an extension pole or the like.

BRIEF DESCRIPTION OF DRAWINGS

In Figures which illustrate non-limiting embodiments of the invention.

DETAILED DESCRIPTION

Figure 1:
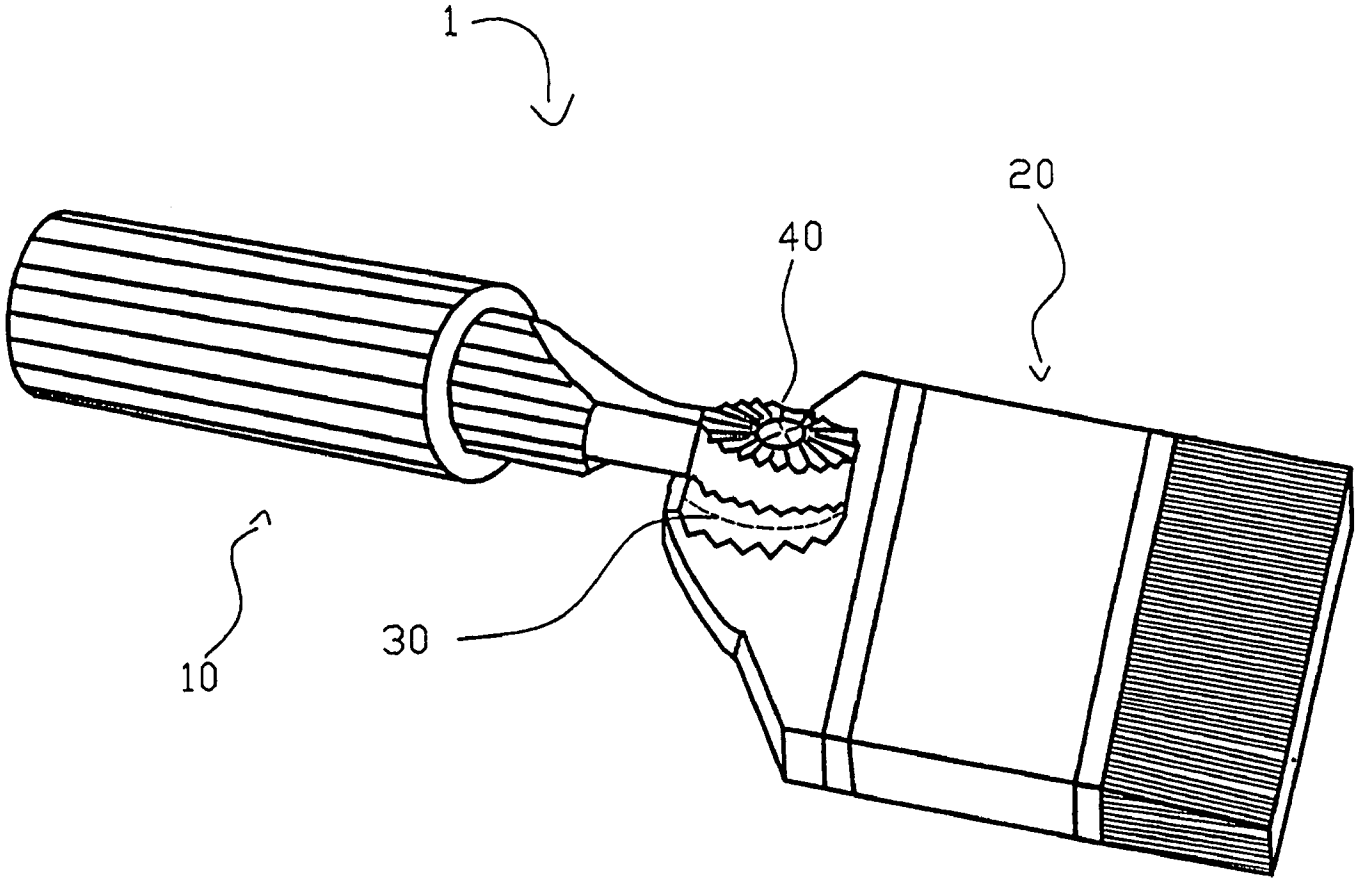
FIG. 1 is a perspective view of a paintbrush according to a preferred embodiment of the invention.
Figure 2:
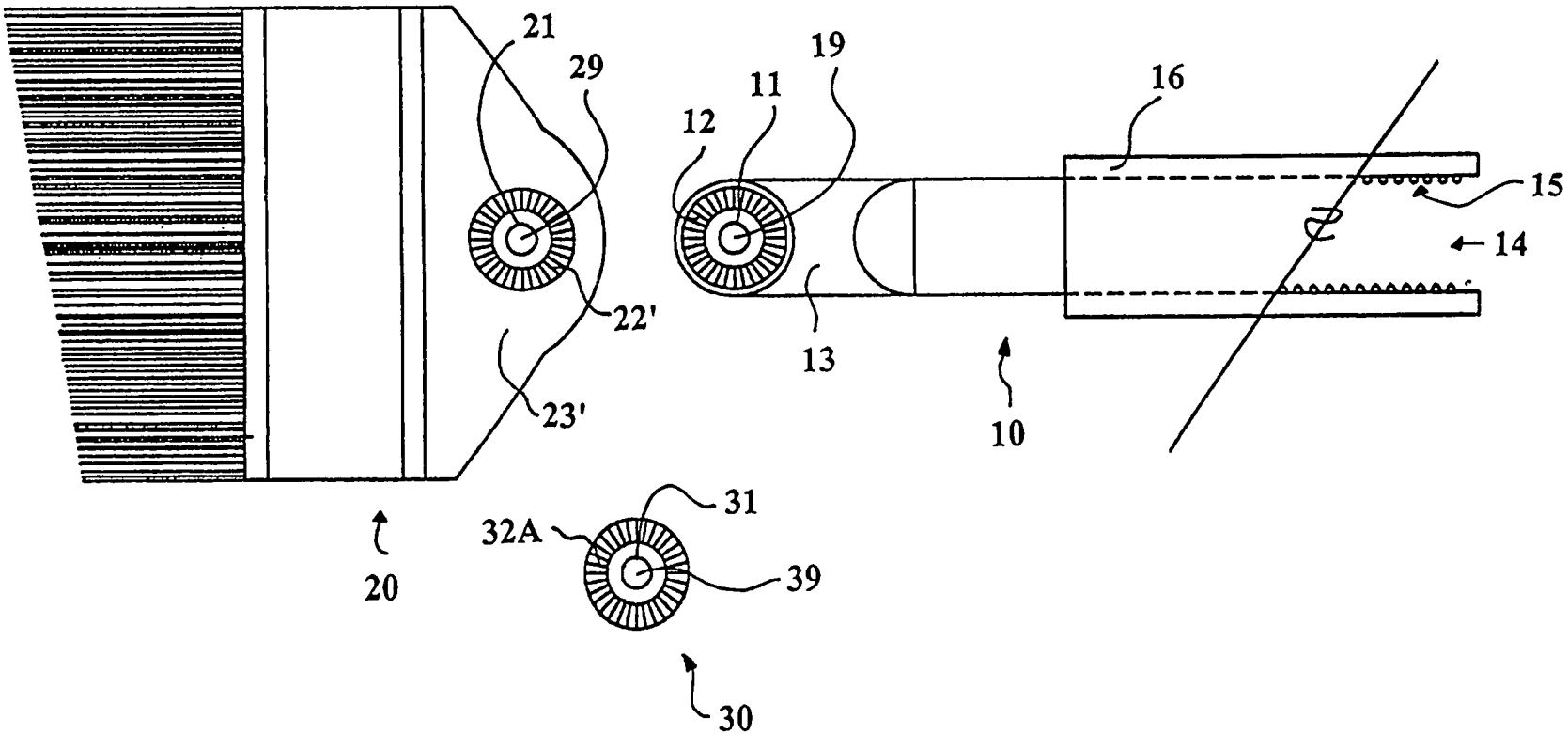
FIG. 2 is an exploded top view of the paintbrush of FIG. 1.
Figure 3:
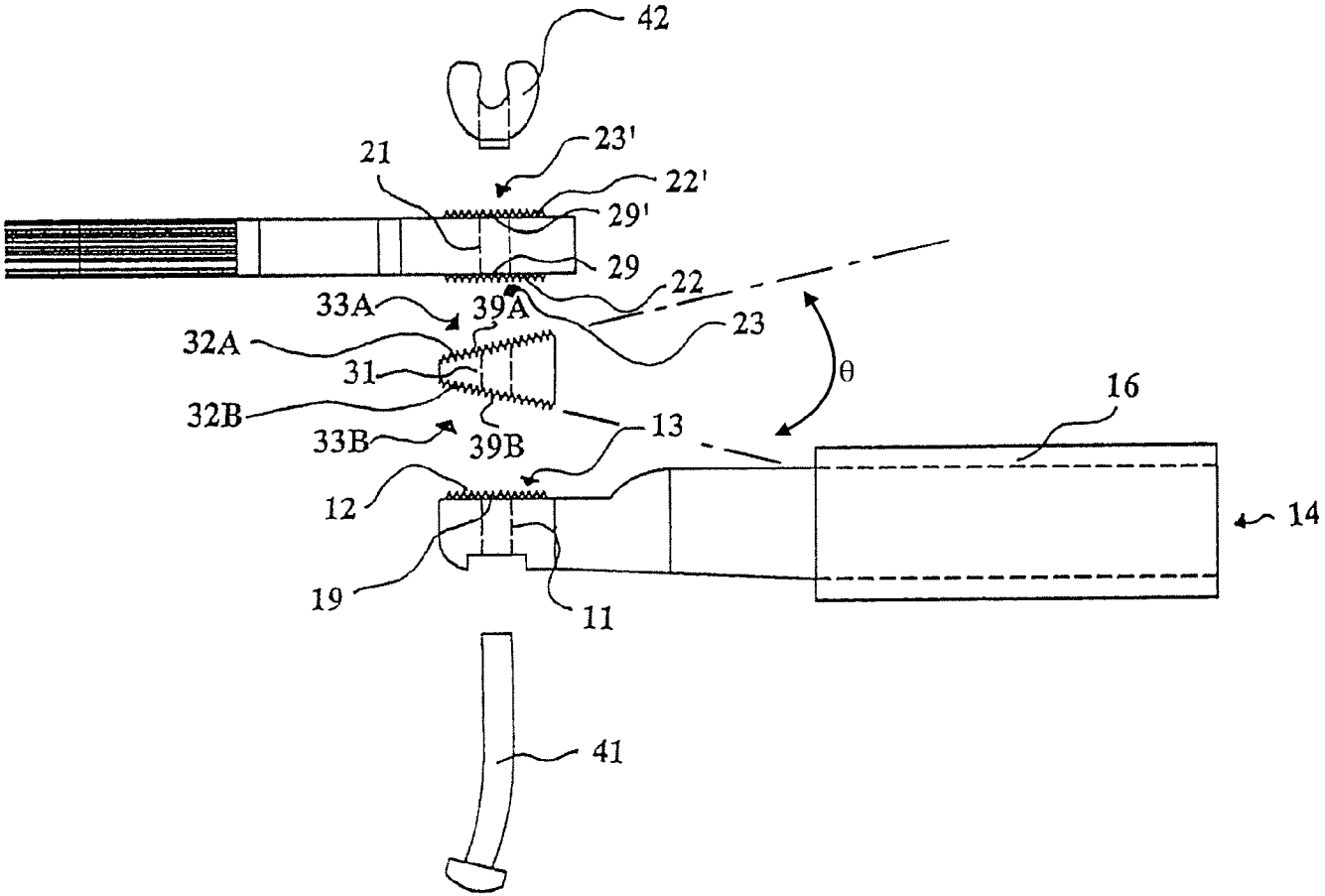
FIG. 3 is a side exploded view of the paintbrush of FIG. 1.

A paintbrush according to a preferred embodiment of the invention is shown in FIG. 1. The exploded views of FIGS. 2 and 3 show constituent parts of paintbrush 1 in more detail.

Paintbrush 1 comprises a handle 10, a head 20, a wedge shaped tilt element 30 and a connecting member 40. Head 20 is attached to handle 10 by way of connecting member 40. When connecting member 40 is loosened, head 20 can be pivoted relative to handle 10. Tilt element 30 is located between handle 10 and head 20. The plane in which head 20 is located can be changed by rotating tilt element 30. Tilt element 30 comprises a top side 33A and a bottom side 33B.

In the preferred embodiments, angle θ (see FIG. 3) between top side 33A and a bottom side 33B is between 20° and 50°. Most preferably angle θ is approximately 30°. It is possible to have wedge shaped tilt element 30 having angle θ outside of this range.

Figure 4:
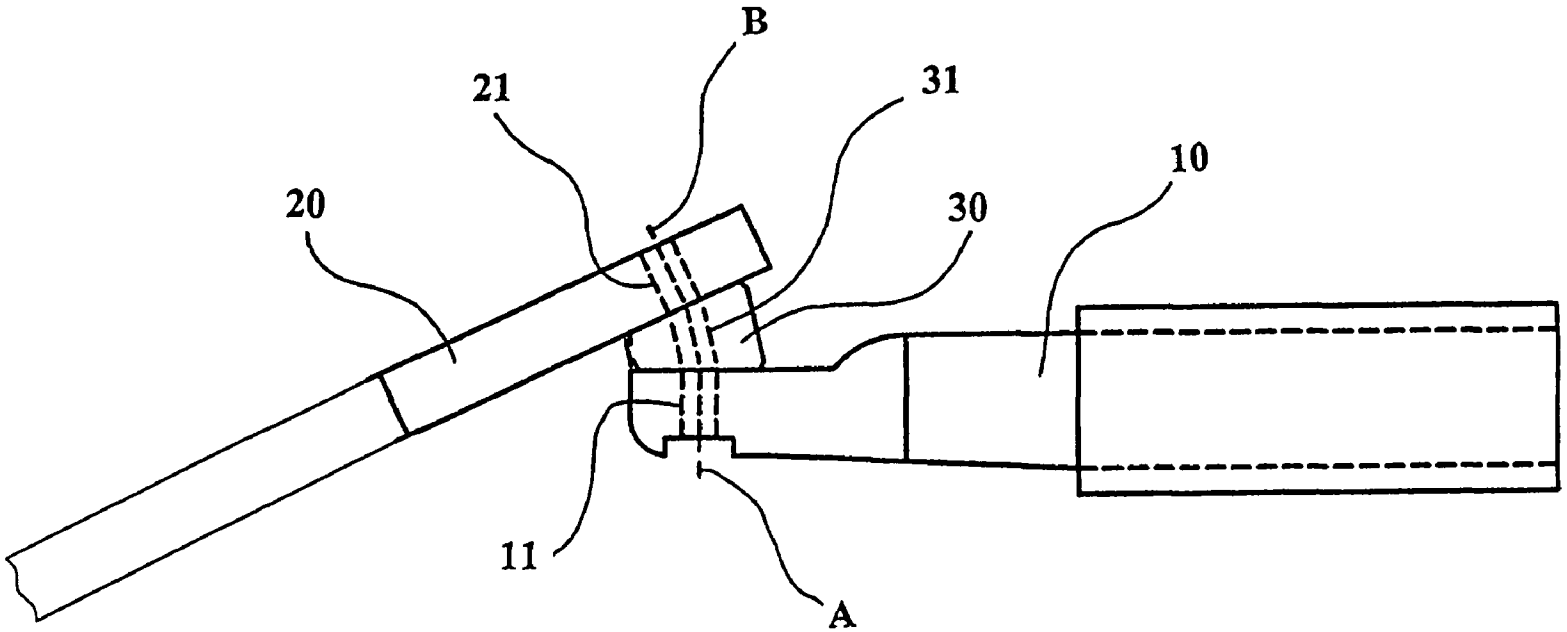
FIG. 4 is a side view of the paintbrush of FIG. 1.

Locking means are provided so that head 20 can be rigidly held in a desired orientation relative to handle 10 while paintbrush 1 is being used. When the locking means are unlocked, handle 10 and tilt element 30 can rotate with respect to one another along a first common axis of rotation A (shown in FIG. 4) which links first point of rotation 19 with bottom side third point of rotation 39B. Furthermore, head 20 and tilt element 30 rotate with respect to one another along a second common axis of rotation B (shown in FIG. 4) which links second point of rotation 29 with top side third point of rotation 39A.

In the illustrated embodiment, the locking means comprise interlocking protrusions. More specifically, handle 10 comprises a first set of protrusions 12 extending from a contact surface 13 and distributed around a first point of rotation 19. Contact surface 13 is preferably flat and oriented in a plane generally parallel to a longitudinal axis of handle 10.

On tilt element 30, a third set of protrusions 32B extends from bottom side 33B. Protrusions 32B are distributed around a bottom side third point of rotation 39B. A fourth set of protrusions 32A extend from top side 33A. Protrusions 32A are distributed around a point of rotation 39A.

Head 20 comprises a second set of protrusions 22 extending from a contact surface 23 of head 20 and distributed around a second point of rotation 29. Contact surface 23 is preferably flat. In the preferred embodiment, head 20 comprises two sets of protrusions positioned on opposite surfaces (i.e. protrusions 22 extending from contact surface 23 and protrusions 22' extending from contact surface 23'). This embodiment gives a user more flexibility in terms of use of head 20.

Where the bristles on head 20 are not symmetrical, as is the case, for example, in a sash brush then head 20 may be reversed so that the same paint brush 1 can be comfortably used by left-handed users and right-handed users. The provision of protrusions 22 and 22' on opposed faces of head 20 facilitate locking head 20 in place relative to tilt element 30 regardless of which way head 20 is installed.

In the preferred embodiment, protrusions 12, 32B, 32A, 22 and 22' comprise a series of triangular protrusions each extending radially from their respective points of rotation. However, the protrusions may have other shapes which are dimensioned so as to be able to interlock with one another i.e. so that protrusions 12 can interlock with protrusions 32B and protrusions 32A can interlock with protrusions 22 and/or protrusions 22'.

In the preferred embodiment, protrusions 32A and 32B extend from a flat circular surface. The positioning of protrusions 32A and 32B on a flat surface in the preferred embodiment is dictated by a protrusions 22 and 12 also being on a flat surface. However, as outlined above, as the requirement is that the protrusions interlock with one another, other surfaces are possible as long as the protrusions continue to interlock with one another. With respect to protrusions 32A and 32B extending from a circular surface, other types of surfaces are possible as long as protrusions 32A and 22/22' can interlock and protrusions 32B and 12 can interlock.

Preferably, protrusion 22 and 12 are similarly dimensioned so as to be able to interlock with one another in the absence of wedge shaped tilt element 30 (i.e. paintbrush 1 can be used without wedge shaped tilt element 30). Consequently, protrusions 32A and 32B are also preferably similarly dimensioned. An advantage of this is that top side 33A and bottom side 33B can be used interchangeably against contact surfaces 13 and 23 (and 23').

Figure 5A:
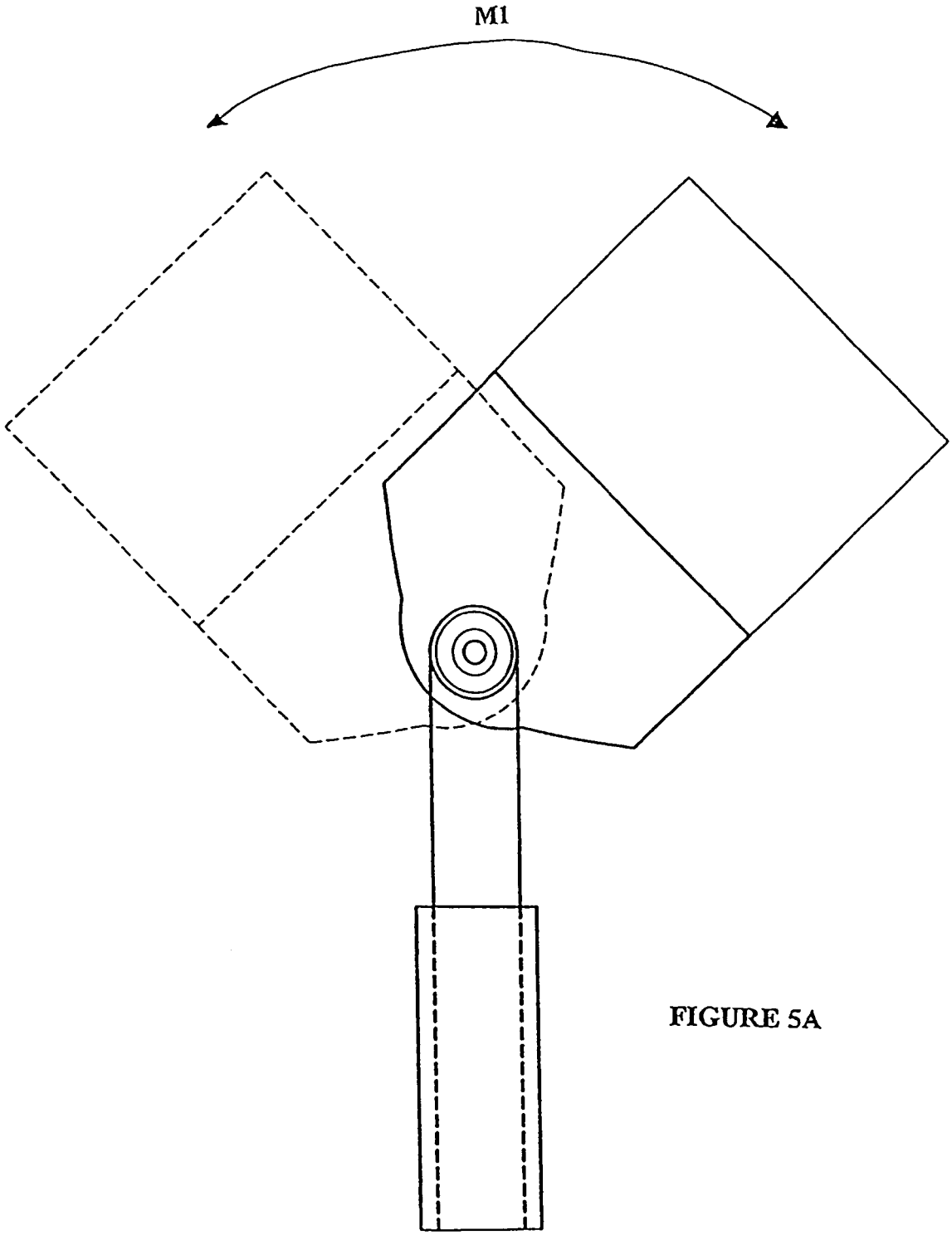
FIG. 5A is a front elevation of a paintbrush according to the invention.
Figure 5B:
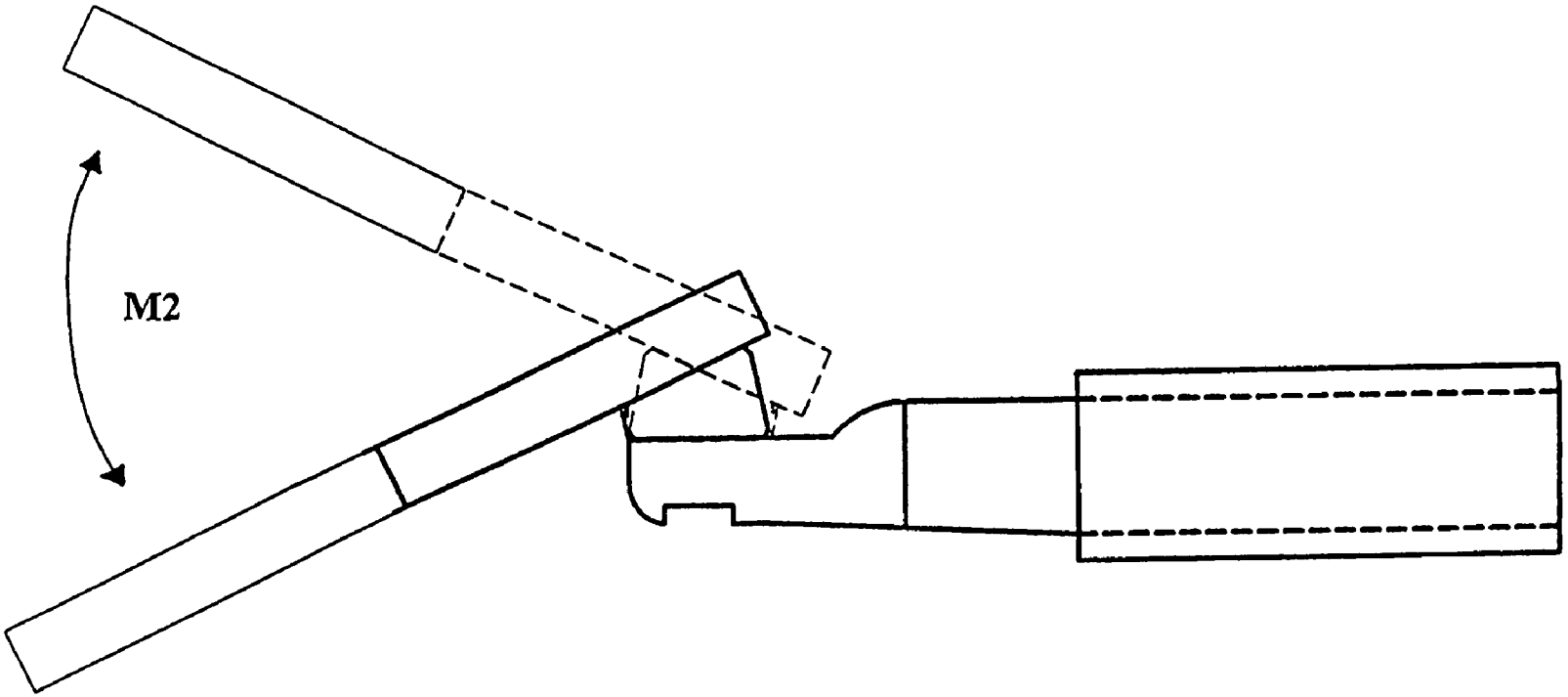
FIG. 5B is a side elevation of a paintbrush according to the invention.

It can be appreciated that the construction of paintbrush 1 allows head 20 to be locked in place in various positions relative to handle 10. Head 20 can be pivoted from side to side as indicated by arrow M1 in FIG. 5A. With the rotation of tilt element 30 relative to handle 10 and/or head 20, head 20 can also be inclined into various positions as shown by arrow M2 in FIG. 5B.

Indeed, many desired head 20/handle 10 positions can be achieved by rotating head 20 with respect to wedge shaped tilt element 30 and/or by rotating handle 10 with respect to wedge shaped tilt element 30.

During use, all three elements of paintbrush 1 (head 20, wedge shaped tilt element 30 and handle 10) are held together by a connecting member 40 which releasably holds the elements against one another.

In the preferred embodiment, connecting member 40 comprises a clamping mechanism which is illustrated as a screw 41 and a wing nut 42. Screw 41 is received inside apertures extending through each element along the relevant axis of rotation: aperture 11 extends through handle 10, aperture 21 extends through head 20 and aperture 31 extends through wedge shaped tilt element 30. Screw 41 is dimensioned to pass through the internal dimensions of successive apertures 11, 31 and 21. Wing nut 42 may be tightened to hold the parts of paintbrush 1 in desired orientations relative to one another or loosened to permit the relative orientations of the parts to be changed.

Preferably, aperture 11 extends through handle 10 along axis of rotation A and aperture 21 extends through head 20 along axis of rotation B. Aperture 31 is of a shape and dimension to be able to provide a connection between aperture 11 and aperture 21, when all three elements of paintbrush 1 are held together, and to receive screw 41. Consequently, screw 41 is preferably bent to correspond to the internal dimensions of successive apertures 11, 31 and 21. A shorter straight screw 41' may be supplied to facilitate using paintbrush 1 without wedge shaped tilt element 30.

Figure 6:
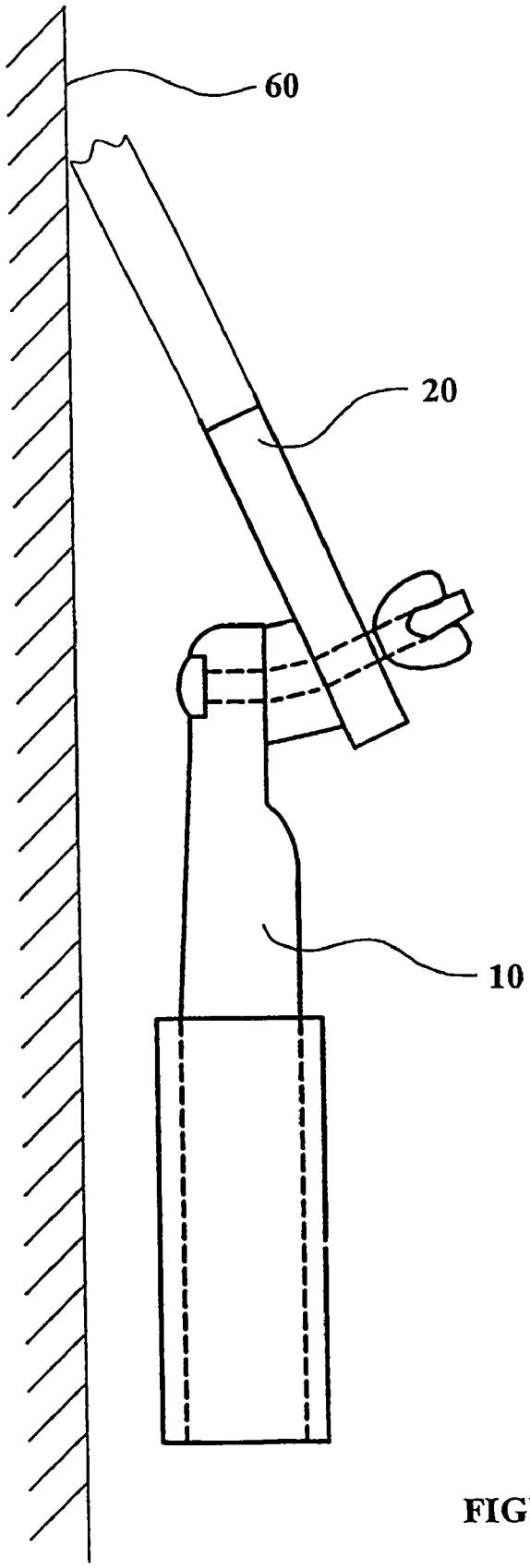
FIG. 6 is a side view of a paintbrush in use according to the invention.

As shown in FIG. 6, the construction of paintbrush 1 allows a user to paint a wall 60 with head 20 hitting wall 60 at a proper angle without the user having to place handle 10 at a similar angle. For painting in hard-to-reach places, such as areas around ceiling/wall corners, the ability to have angle of handle 10 with respect to wall 60 different from the angle of head 20 with respect to wall 60 is of value.

Outer end 14 of handle 10, located distally from contact surface 13, preferably has a rounded cross section so as to enable a user to better grasp and hold handle 10. In the preferred embodiment, outer end 14 of handle 10 comprises a threaded female socket 15 so as to be able to receive a similarly dimensioned threaded male element. Consequently, handle 10 can be screwed to an end of an extension pole for extending a painter's reach.

In the preferred embodiment, outer end 14 is coated with a layer of a cushioning material 16, such as rubber, to further increase the user's comfort in holding handle 10.

As will be apparent to those skilled in the art in the light of the foregoing disclosure, many alterations and modifications are possible in the practice of this invention without departing from the spirit or scope thereof. For example:

- the connecting member may comprise a clamp to releasably secure handle 10—tilt element 30—head 20 to one another, thereby obviating the need for apertures;
- the locking means may comprise surfaces with high coefficients of friction, such as rubberised surfaces, thereby obviating the need for one or more of the sets of interlocking protrusions;
- the contact surfaces may have various shapes and dimensions which enable all three elements of paintbrush 1 (head 20, wedge shaped tilt element 30 and handle 10) to be held together by the connecting member;
- the clamping mechanism may comprise a toggle or other clamping mechanism capable of holding the parts of paintbrush 1 together so that they are fixed in orientation relative to one another;
- the paintbrush may comprise a foam pad for holding and spreading paint in place of conventional bristles. The term paint dispensing element includes bristles, foam paint-dispensing elements and other functionally equivalent things; and,
- the locking means may comprise a pin on one part which can be selectively received in one of a plurality of holes, recesses, indentations or the like on another part to prevent relative rotation of the parts.

Accordingly, the scope of the invention is to be construed in accordance with the substance defined by the following claims.

What is claimed is:

1. A paintbrush comprising:

(a) a handle extending generally along a central longitudinal handle axis;

(b) a body supporting a paint dispensing element;

(c) a wedge-shaped tilt element positioned between the body and the handle; and, (d) a connector for releasably holding the handle against a first side of the tilt element and a second side of the tilt element against the body, wherein the connector is configurable to a released configuration in which the tilt element and the handle can pivot with respect to one another about a first adjustment axis that is substantially orthogonal to the handle axis and in which the tilt element and the body can pivot with respect to one another about a second adjustment axis, the second adjustment axis and the first adjustment axis forming an acute angle therebetween.

2. A paintbrush as recited in claim 1, comprising:

(a) a first aperture extending through the handle;

(b) a second aperture extending through the body; and, (c) a third aperture extending through the tilt element, wherein the connector comprises a nut and bolt, the bolt has a bent shape to provide a first shank portion that extends in axial alignment with the first adjustment axis through the first aperture and at least partially through the third aperture and a second shank portion that extends in axial alignment with the second adjustment axis through the second aperture and at least partially through the third aperture.

3. A paintbrush as recited in claim 2 wherein the first and second apertures are generally cylindrically shaped.

4. A paintbrush as recited in claim 1 wherein at least one of the first side of the tilt element and the handle is patterned to prevent relative pivotal movement between the tilt element and the handle when the connector is configured in a locked configuration.

5. A paintbrush as recited in claim 1 wherein at least one of the second side of the tilt element and the body is patterned to prevent relative pivotal movement between the tilt element and the body when the connector is configured in a locked configuration.

6. A paintbrush as recited in claim 1 wherein:

(a) the handle comprises a first set of protrusions extending from a surface of the handle and distributed around a first point of rotation;

(b) the body comprises a second set of protrusions extending from a surface of the body and distributed around a second point of rotation; and, (c) the tilt element comprises:

(i) a third set of protrusions extending from the first side of the tilt element and distributed around a third point of rotation, and (ii) a fourth set of protrusions extending from the second side of the tilt element and distributed around a fourth point of rotation, wherein the first point of rotation and the third point of rotation are aligned on the first adjustment axis, wherein the second point of rotation and the fourth point of rotation are aligned on the second adjustment axis, wherein the first set of protrusions and the third set of protrusions are shaped so that they can interlock with one another, wherein the second set of protrusions and the fourth set of protrusions are shaped so that they can interlock with one another.

7. A paintbrush as recited in claim 6, wherein the first, second, third and fourth sets of protrusions are shaped so that they can interlock with one another.

8. A paintbrush as recited in claim 6, wherein (a) the first set of protrusions comprises a plurality of triangular protrusions extending radially from the first point of rotation and arranged in a first plane generally orthogonal to the first adjustment axis;

(b) the second set of protrusions comprises a plurality of triangular protrusions extending radially from the second point of rotation and arranged in a second plane generally orthogonal to the second adjustment axis;

(c) the third set of protrusions comprises a plurality of triangular protrusions extending radially from the third point of rotation and arranged in a third plane generally orthogonal to the first adjustment axis; and, (d) the fourth set of protrusions comprises a plurality of triangular protrusions extending radially from the fourth point of rotation and arranged in a fourth plane generally orthogonal to the second adjustment axis.

9. A paintbrush as recited in claim 6, comprising:

(a) a first aperture extending through the handle;

(b) a second aperture extending through the body; and, (c) a third aperture extending through the tilt element, wherein the connector comprises a nut and bolt assembly, the bolt has a bent shape to provide a first shank portion that extends in axial alignment with the first adjustment axis through the first aperture and at least partially through the third aperture and a second shank portion that extends in axial alignment with the second adjustment axis through the second aperture and at least partially through the third aperture.

10. A paintbrush as recited in claim 9, wherein:

(a) the first aperture extends through the handle and along the first adjustment axis; and, (b) the second aperture extends through the body and along the second adjustment axis.

11. A paintbrush as recited in claim 9, wherein a distal end of the handle, distally located from the first set of protrusions, is hollow and adapted to be removably attachable to an end of a longitudinal handle-extension element.

12. A paintbrush as recited in claim 9 wherein the first and second apertures are generally cylindrically shaped.

13. A paintbrush as recited in claim 1 wherein the acute angle is in a range of 20°-50°.

14. A paintbrush comprising:

(a) an elongated handle extending generally along a central longitudinal handle axis, the handle comprising:

(i) a first aperture extending through the handle at one end of the handle, and (ii) a first set of protrusions distributed around an orifice of the first aperture;

(b) a body holding bristles, the body comprising:

(i) a second aperture extending through the body, and (ii) a second set of protrusions distributed around an orifice of the second aperture;

(c) a wedge-shaped tilt element comprising:

(i) a third aperture extending through the tilt element and linking first and second opposing surfaces of the tilt element, and (ii) a third set of protrusions positioned on the tilt element's first surface and distributed around a first orifice of the third aperture, and (iii) a fourth set of protrusions positioned on the tilt element's second surface and distributed around a second orifice of the third aperture; and (d) a nut and bolt assembly, for removably holding the handle against the first surface of the tilt element and the body against the second surface of the tilt element;

wherein the first set of protrusions and the third set protrusions are shaped so that they can interlock with one another, wherein the second set of protrusions and the fourth set of protrusions are shaped so that they can interlock with one another, wherein the handle and the tilt element are pivotable with respect to one another about a first adjustment axis when the nut and bolt assembly is un-tightened, the first adjustment axis substantially orthogonal to the handle axis, and wherein the body and the tilt element are pivotable with respect to one another about a second adjustment axis when the nut and bolt assembly is un-tightened, the second adjustment axis and the first adjustment axis forming an acute angle therebetween.

15. A paintbrush as recited in claim 14 wherein the acute angle is in a range of 20°-50°.

* * * * *